United States Patent [19]

Kageyama et al.

[11] Patent Number: 4,748,057

[45] Date of Patent: May 31, 1988

[54] COATING METHOD

[75] Inventors: Takashi Kageyama; Makoto Yoshida, both of Hino, Japan

[73] Assignee: Konishiroku Photo Industry Co., Ltd., Tokyo, Japan

[21] Appl. No.: 804,321

[22] Filed: Dec. 3, 1985

Related U.S. Application Data

[63] Continuation of Ser. No. 492,456, May 5, 1983, abandoned.

[30] Foreign Application Priority Data

May 19, 1982 [JP] Japan ..... 57-83221

[51] Int. Cl.[4] ..... B05D 1/26; B05C 5/02

[52] U.S. Cl. ..... 427/356; 118/410

[58] Field of Search ..... 427/356, 358; 418/410, 418/411, 412, 401

[56] References Cited

U.S. PATENT DOCUMENTS

| | | | |
|---|---|---|---|
| 3,749,053 | 7/1973 | Timson | 118/412 X |
| 3,869,304 | 3/1975 | Bogulslawski et al. | 118/410 X |
| 3,996,889 | 12/1976 | Otten et al. | 118/413 X |
| 4,023,526 | 5/1977 | Ashmus et al. | 118/410 |
| 4,050,410 | 9/1977 | Stroszynski | 118/410 |
| 4,299,186 | 11/1981 | Pipkin et al. | 118/410 X |
| 4,445,458 | 5/1984 | O'Brien | 118/410 X |

*Primary Examiner*—John P. McIntosh

*Attorney, Agent, or Firm*—Jordan B. Bierman

[57] ABSTRACT

A method of coating a web comprising passing a stream of coating material through an opening to form a layer on the web and thereafter passing the material through two pressure zones, the first of which is convergent and the second being divergent.

8 Claims, 3 Drawing Sheets

COATING METHOD

This application is a continuation of Application Ser. No. 492,456, filed May 5, 1983, now abandoned.

BACKGROUND OF THE INVENTION

The present invention relates to the improvement of the so-called extrusion coating apparatus and more particularly to the extrusion coating apparatus wherein a wetting property between a web and coating liquid especially for the liquid with a high viscosity has been improved and thereby a uniform coated layer can be obtained.

A conventional extrusion coating machine and a backup roll is illustated in FIG. 1. In the figure, 1 is a web, 2 is the first block of the coating apparatus having on its tip an edge 3 stretching in the direction of the width of a web 1, and 4 is the second block formed in the same manner as the first block 2 and having an edge 3'. Between the first block 2 and the second block 4, the slit 5 is formed and the total amount of the coating liquid 6 is supplied from the slit 5 to the narrow gap h as the edge 3 runs parallel to the web 1. When such coating apparatus is used for coating, it is known that the coating is made with a relation of "h=2hw," where the thickness of a coated layer is hw, and it is also known that the relation is dependent on the physical properties (viscosity in particular) of coating liquid and a coating speed. However, when a uniformity of the coated layer is required on a high accuracy basis like the case of photographic photosensitive material or of magnetic recording material and others, there have been disadvantages that the position X where the coating liquid 6 first touches the web 1 (hereinafter referred to as "a coating liquid contact line") will be zigzagged in the direction of the width of web 1 when the viscosity of coating liquid 6 is high, and streak defects tend to be generated in the traveling direction of the web 1. This has been caused by insufficient wetting between coating liquid 6 and the web 1, in particular, so-called coating defects are generated in the form of cross lines wherein wetting portions and non-wetting portions appear alternately on the surface of the web 1 in its lateral direction. Further, there has been an inconvenience that the thickness of a layer is directly influenced by the variation in the gap h between the edge 3 and the web 1 caused by unavoidable causes such as an eccentricity of the backup roll (not illustrated), for example, or the thickness variation of the web 1, because the thickness of the coated layer is controlled by the relation of "hw=h/2" as mentioned before.

The inventors of the present invention, after an intensive study for the solution of aforesaid problems, found that the problem of coating defects mentioned above may be solved to a certain extent by an improvement in the wetting property of the web or the means therefore, such as lowering of the surface tension of the liquid or the like. It is further found that the problem of coating defects becomes pronounced especially when the viscosity is high and the coating speed is increased.

The position of the coating liquid contact line is controlled by the wetting property of the web surface and by the surface tension of the liquid and further by the pressure generated by the flow of coating liquid in the gap between the web and the edge. Such pressure depresses the contact line in the direction opposite to the traveling direction of the web against the force of the web to carry the liquid away in its traveling direction and thus the position of the contact line is settled by the balance of these forces. Therefore, as the viscosity of the liquid becomes higher or as the coating speed becomes higher, the force of the web to carry the liquid away becomes stronger and exceeds the pressure generated, and thereby the balance is lost causing a zigzag of the contact line in the direction of the width and the coating defects mentioned above thus to take place.

Further, as the second cause for coating defects, air tends to enter the gap between the second block of the coating apparatus and the web for the high speed coating whereby the streak defects are considered to take place. Such defects may be solved if the gap is eliminated, but without a gap the web tends to be damaged by the backup roll and the coating apparatus and if there should be dust or other items, the web will be torn. Therefore, the gap can not be eliminated.

After studying such causes, the inventors of the present invention found that all aforesaid problems will be solved by increasing the pressure to be generated by the flow of the coating liquid in the gap and further found that this will solve aforesaid problem of variation in the thickness of the coated layer.

SUMMARY OF THE INVENTION

The first object of the present invention is to provide an extrusion coating apparatus that enables to obtain a uniform coated layer even under the conditions of high viscosity of liquid and high speed coating.

The second object of the present invention is to provide an extrusion coating apparatus that can keep the thickness of coated layer constant despite the variation in the gap between the web and the edge.

Aforesaid objects of the present invention may be attained by an extrusion coating apparatus having a continuously traveling web supported by a backup roll and a hopper having on its tip a slit stretching in the direction of a web width. There are two edges forming said slit with gaps are formed between the web and the edges and the total amount of coating liquid is supplied in the gap on the side in the traveling direction of the web. The the edge forming the gap on that side has a shape capable of forming at least one pair of zones where a convergent flow and a divergent flow is formed successively.

The present invention has an effect that it is possible to improve the wetting property between the web and coating liquid and to obtain a uniform coated layer even under the conditions of high viscosity liquid and high coating speed, and further it is possible to keep the thickness of the coated layer constant even when the gap between the web and the edge varies.

DETAILED DESCRIPTION OF THE PREFERRED EMBODIMENTS

A preferred embodiment of the present invention will be described with reference to the drawings attached hereto.

Figure 7:
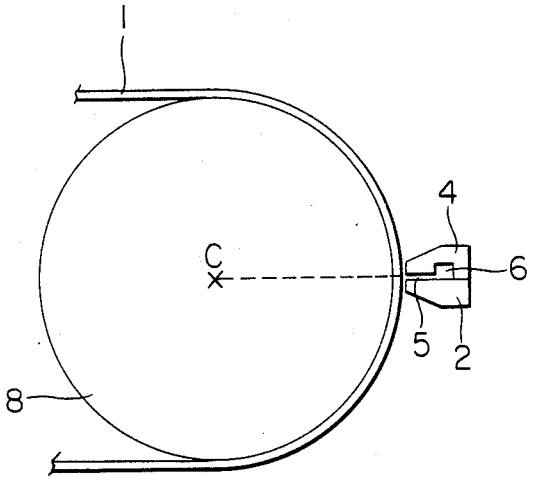
FIG. 7 is a schematic structural view showing a preferable positional relation between the coating apparatus and the backup roll of the present invention.

As shown in FIG. 7, the direction of the flow of the coating liquid in the slot 5 of the coating apparatus of the present invention points to the center C of the backup roll 8.

Figure 1:
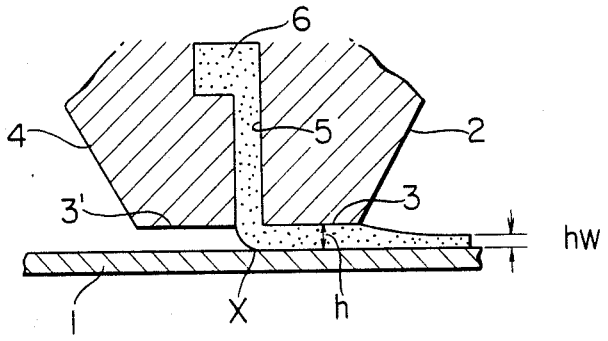
FIG. 1 is a partial schematic sectional view showing a conventional extrusion coating apparatus.
Figure 2:
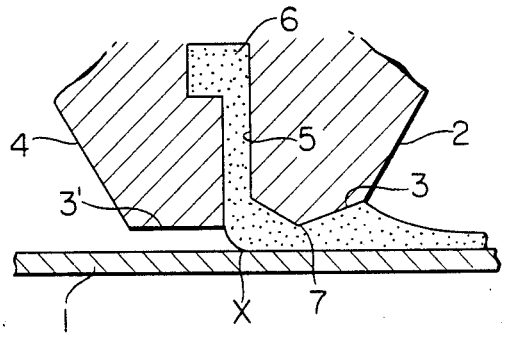
FIG. 2 is a partial schematic sectional view showing an embodiment of the coating apparatus of the present invention.

In FIG. 2, the edge 3 stretching in the direction of the width of web 1 on the tip of the first block 2 of the coating apparatus has two zones—A zone (upper left side in the drawing) descending to the right side (with a tilt angle of $\theta 1$) and B zone (upper right side in the drawing) ascending to the right side (with a tilt angle of $\theta 2$). Therefore, the constitution thereof allows the gap between the edge 3 and the web 1 to decrease in the A zone and it allows the gap to increase in the B zone. Incidentally, the portion 7 where A zone switches to B zone need not be as shown in the drawing (straight line in the direction of the width of web 1) but it has only to have the inclined zones mentioned above. Further, the height of the edge 3' formed on the tip of the second block 4 and stretching in the direction of the width of web 1 may be identical to or different from the height of the edge 3 of the aforesaid first block 2.

Now, when the horizontal lengths in the advancing direction of the coating liquid in both A zone and B zone of aforesaid first block 2 (hereinafter referred to as a "horizontal length") and l1 and l2, a horizontal length of the edge 3' of the portion parallel to the web 1 is l3 and the difference of the height between the edge 3 and the edge 3' is k, it is preferable, as an embodiment of the present invention, to select the dimensions so that $l1=0.1$–$1$ mm, $l2=0.1$–$2$ mm, $l3=0.5$–$2$ mm, $\theta 1=2°$–$60°$, $\theta 2=2°$–$60°$ and $k=+0.1$–$-0.1$. It is further preferable to select particular dimensions so that $l1=0.1$–$0.5$ mm, $l2=0.1$–$1$ mm, $l3=0.5$–$1$ mm, $\theta 1=5°$–$30°$, $\theta 2=5°$–$10°$ and $k=0$ mm–$-0.05$ mm. Incidentally, the negative sign (−) for k means that the edge 3' is lower than the edge 3. Figures mentioned above are just a preferable example and the present invention is not limited to such figures.

The function of the present invention having aforesaid constitution will be explained. The ranges of the viscosity of coating liquid and the coating speed to be applied to the present invention is very wide. The present invention exhibits its effect especially when coating liquid with a high viscosity is used and it may be applied to the viscosity of 500 centipoise (hereinafter referred to as "cp") or more and it even is possible to employ coating liquid with 5000–10000 cp. Further, the present invention exhibits its effect especially when the coating speed is high and it is even possible to use the coating speed of 100 m/min or more.

When coationg liquid 6 as mentioned above is applied onto the web 1 from the slot 5, the flow thereof will be a convergent flow in the A zone and a pressure is generated. Owing to the generation of such pressure, the contact line X may be depressed in the direction of the arrow in FIG. 3, whereby the wetting force is generated and the contact line X can be kept uniform in the direction of the width of the web. When coating liquid 6 enters the B zone, the flow will be a divergent flow and the pressure drops. FIG. 4 shows the pressure-increasing state in the traveling direction in A zone and the pressure-decreasing state in the traveling direction in B zone. In the figure, the curve I shows the state wherein the upper surface of the web 1 is located at Ia in FIG. 3, the curve II shows the state for IIa likewise and the curve III shows the state for IIIa in FIG. 3 respectively.

Figure 3:
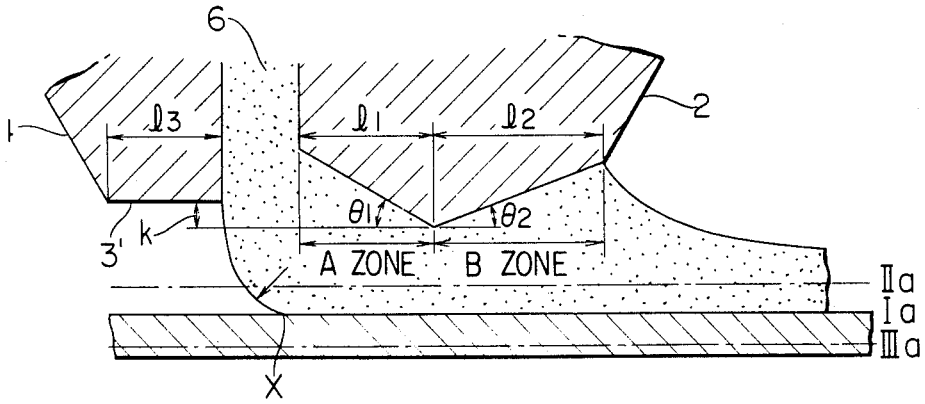
FIG. 3 is a partial enlarged sectional view of FIG. 2.
Figure 4:
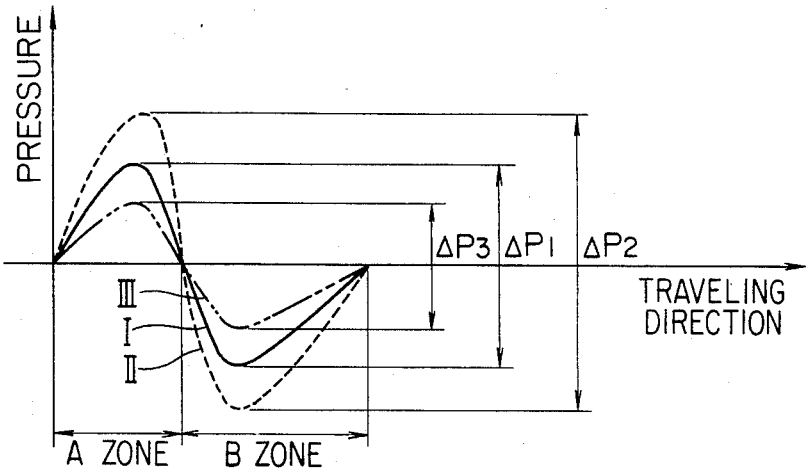
FIG. 4 is a graph showing the pressure variation of coating liquid used in the apparatus of FIG. 2, FIG. 5 and FIG. 6 are partial schematic sectional views showing another embodiment of the coating apparatus of the present invention

When the web 1 is located at Ia in FIG. 3 and the pressure change is like the curve I in FIG. 4, the maximum pressure difference $\Delta P1$ is generated. Owing to causes such as an eccentricity of the roll, a variation in the thickness of the web 1 or the like, if the gap between the edge 3 and the web 1 is narrowed (if the position of the web 1 is changed to the position of IIa in FIG. 3), the amount of coating liquid flowing becomes small and thereby the thickness of the layer (hw) tends to be thin. The pressure, on the other hand, changes according to the curve II in FIG. 4 and the pressure difference $\Delta P2$ is generated. Therefore, $\Delta P2$ is greater than $\Delta P1$ and the pressure difference therefrom becomes the driving force to increase the amount of flowing liquid. It functions, in this manner, to increase the thickness of the layer (hw), namely, to restore to the normal thickness (the position of Ia in FIG. 3). When the gap is widened to the contrary (when the position of the web 1 is changed to the position of IIIa in FIG. 3), the flowing amount of coating liquid becomes large and thereby the thickness of the layer (hw) tends to be thick. Meanwhile, the pressure changes are according to the curve III in FIG. 4 and the pressure difference $\Delta P3$ is generated. Therefore, $\Delta P3$ is smaller than $\Delta P1$ and the reduction in the pressure difference therefrom functions to decrease the flow rate. It functions, in this manner, to thin the thickness of the layer (hw), namely, to restore it to the normal thickness (the position of Ia in FIG. 3). It is the feature of the present invention that the restoring force acts toward restoring to the original thickness even if the gap becomes greater or it becomes smaller, as mentioned above.

Figure 5:
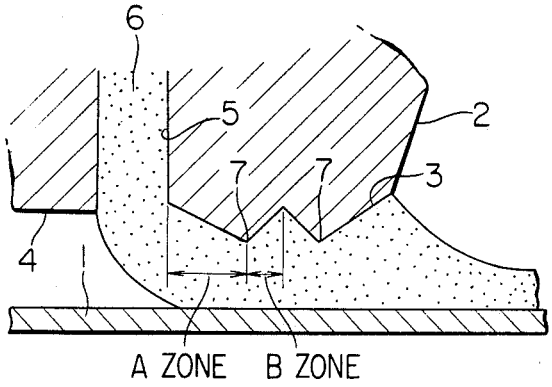
Figure 6:
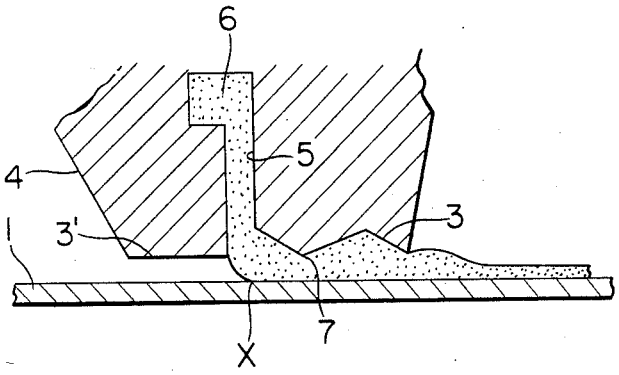

The foregoing is an illustration of an example of the present invention and the present invention is not limited to the described embodiment, but it is possible to improve upon it in various other embodiments. For example, as shown in FIG. 5, plural pairs of zones, wherein each pair consists of an A zone that forms a convergent flow and a B zone that forms a divergent flow, may be provided. Furthermore, as shown in FIG. 6, there may be a structure having the number of zones exceeding one pair, with the trailing edge on the side in the traveling direction of the web ending with a convergent flow. Further, the member having the shape of the edge in the present invention may be formed separately and it may be attached on the coating apparatus.

Concrete examples will be explained as follows.

EXAMPLE 1

| (Specifications of coating appratus) |
|---|
| Diameter of back roll = 150 mmϕ<br>Thickness of base film = 15 μm × 600 mm width<br>l1 = 300μ, l2 = 700 μm, l3 = 1 mm<br>Slot width = 500 μm, θ1 = 18°, θ2 = 8° |

With the aid of the coating apparatus having aforesaid specifications, magnetic grain-dispersed liquid with a viscosity of 5000 cp for the use of magnetic tape was coated on the base film at the coating speed of 200 m/min so that the thickness of coated layer (hd) after drying would be 5 μm.

After the coating, no streak defect was found over the entire width and the variation of the thickness of layer (hd) was not higher than ±2%.

EXAMPLE 2

| (Specifications of coating apparatus) |
|---|
| Diameter of back roll = 200 mmϕ<br>Thickness of base film = 100 μm × 300 mm width<br>$l1 = l2 = 500$ μm<br>$\theta 1 = \theta 2 = 7°$ |

Coating liquid with a viscosity of 1000 cp was coated on the base film at the coating speed of 150 m/min so that the thickness of coated layer (hd) after drying would be 3 μm.

After the coating, the variation of the thickness of coated layer (hd) was not higher than ±1%, which means a uniform coating.

What we claim is:

1. A method of coating a web traveling in a predetermined downstream direction comprising passing a stream of coating material through an opening to form a layer on said web, thereafter passing said material through a first convergent pressure zone and then through a second divergent pressure zone, and supporting said web by a back-up roll in said zones, and wherein said material fills said first and second zones.

2. The method of claim 1, wherein said web is traveling continuously.

3. The method of claim 1, wherein said material is a liquid.

4. The method of claim 1, wherein said opening is a slit extending transversely of said direction.

5. The method of claim 4 wherein said slit has an upstream edge and a downstream edge.

6. The method of claim 1, further comprising passing said material through a third convergent pressure zone downstream of said second zone.

7. The method of claim 1, further comprising passing said material through a plurality of successive alternate convergent and divergent pressure zones.

8. The method of claim 1, wherein said material flows through said opening in the direction of the center of said roll.

* * * * *